US006095066A

United States Patent [19]

Nöltge et al.

[11] Patent Number: 6,095,066

[45] Date of Patent: Aug. 1, 2000

[54] EYELET-BUTTONHOLE SEWING MACHINE

[75] Inventors: Thomas Nöltge, Bielefeld; Jochen Fischer, Detmold, both of Germany

[73] Assignee: Dürkopp Adler AG, Germany

[21] Appl. No.: 09/256,853

[22] Filed: Feb. 24, 1999

[30] Foreign Application Priority Data

Feb. 24, 1998 [DE] Germany ..... 198 07 771

[51] Int. Cl.[7] ..... D05B 3/08

[52] U.S. Cl. ..... 112/66; 112/68; 112/73

[58] Field of Search ..... 112/66, 65, 68, 112/70, 73, 447, 475.25

[56] References Cited

U.S. PATENT DOCUMENTS 1,991,627 2/1935 Reece .
5,873,314 2/1999 Gamano et al. ..... 112/66

FOREIGN PATENT DOCUMENTS 3302385 8/1983 Germany .
3401615 7/1984 Germany .
4132586 4/1992 Germany .

*Primary Examiner*—Peter Nerbun
*Attorney, Agent, or Firm*—Ostrolen, Faber, Gerb & Soffen, LLP

[57] ABSTRACT

A sewing machine having a table, driven in two directions by two motors and accommodating material to be sewn, sewing tools, and a cutting device for producing a buttonhole in the material to be sewn. The buttonhole is provided with an incision and is bounded by zigzag stitches of a buttonhole bead, running around the incision. The incision is produced either before or after the sewing of the buttonhole bead. The sewing tools include a needle bar, which is driven up and down and also oscillates in the horizontal direction, and a needle, which is provided at the bottom end of the needle bar and interacts with a looper mounted in the base plate. The sewing tools are drivable in a rotatable manner by a third motor. The sewing machine has a control device, from which various buttonhole shapes stored therein can be retrieved, a device for switching from the pre-cutting mode to the post-cutting mode, and a needle-oscillating device driven by a fourth motor and producing the zigzag stitches. The control device also controls the oscillating motion of the needle bar in order to produce the intermediate material, required in the post-cutting mode, within the buttonhole bead.

12 Claims, 5 Drawing Sheets

Fig. 1
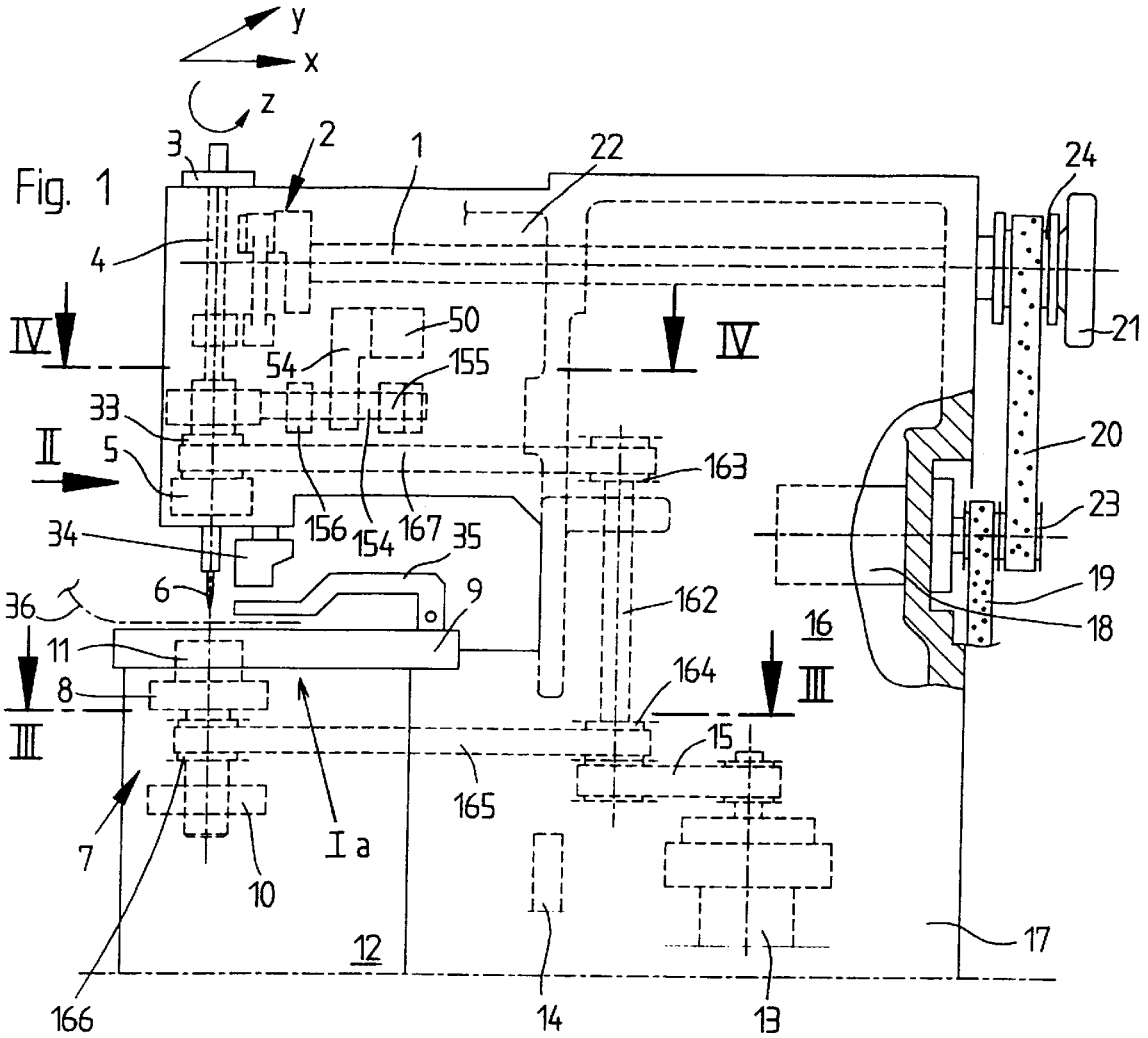
Fig. 3
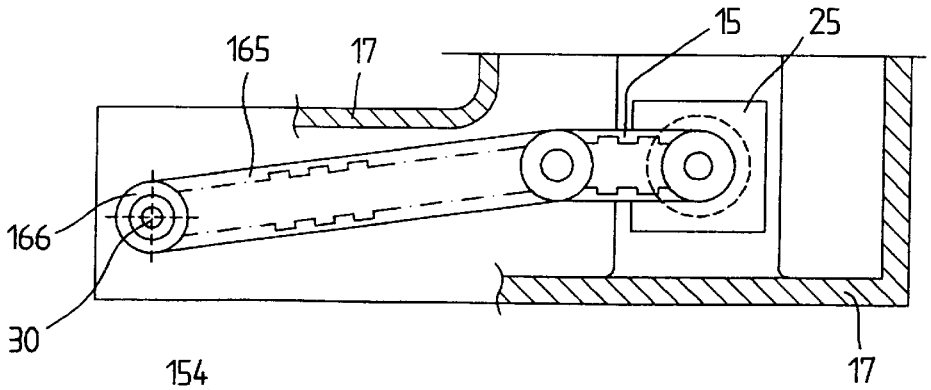
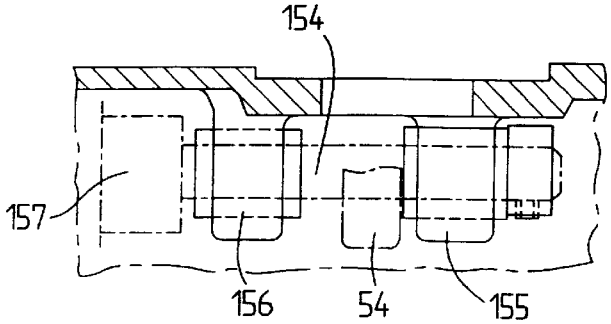
Fig. 4

Fig. 5
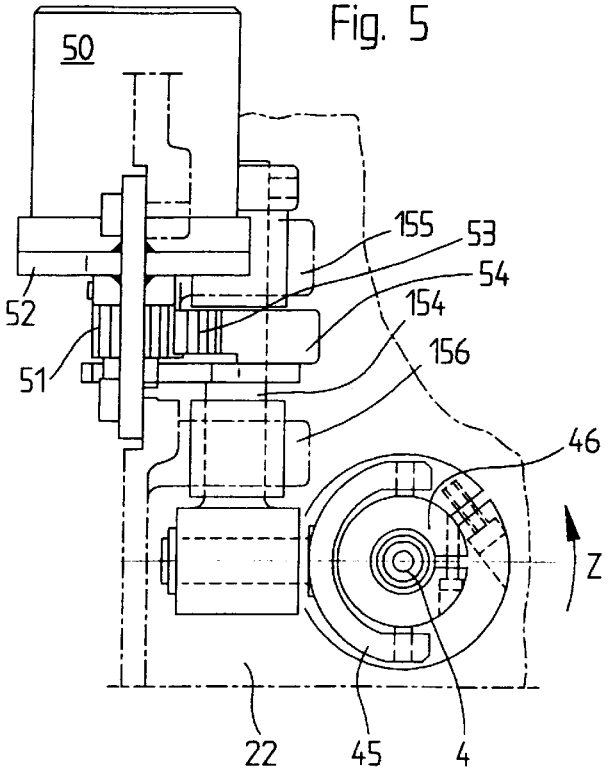
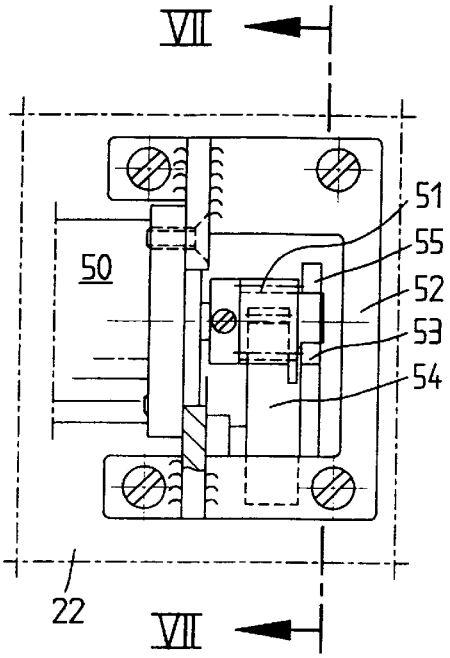
Fig. 6
Fig. 1a
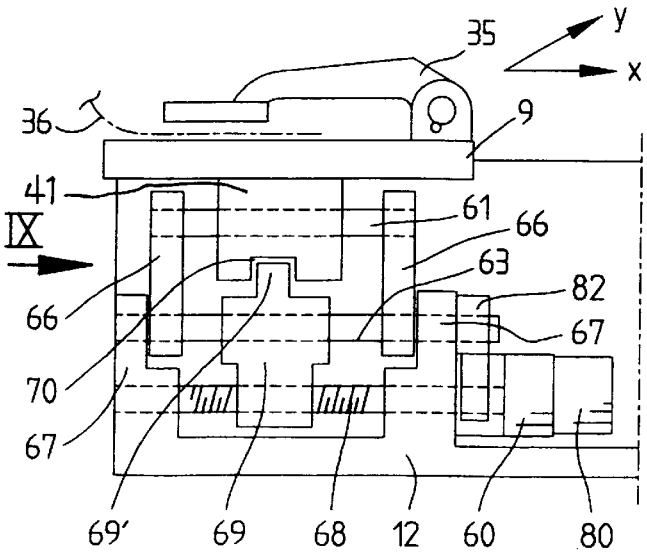
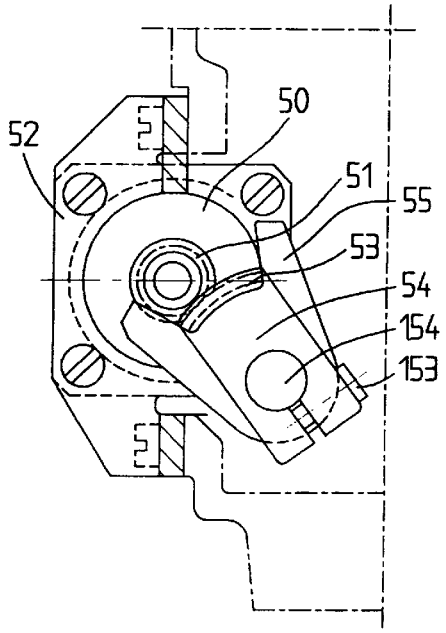
Fig. 7

EYELET-BUTTONHOLE SEWING MACHINE

CROSS-REFERENCE TO RELATED APPLICATION

This is related to the commonly-assigned U.S. patent application Ser. No. 09/256,923, filed on even date herewith, titled EYELET-BUTTONHOLE SEWING MACHINE, the disclosures of which are incorporated by reference herein.

BACKGROUND OF THE INVENTION

The invention relates to an improvement in a sewing machine having a table, driven in two directions by two motors and accommodating material to be sewn, sewing tools and a cutting device for producing a buttonhole in the material to be sewn. The buttonhole is defined by a buttonhole bead which is formed of zigzag stitches, running around an incision, the incision being produced either before or after the sewing of the buttonhole bead. The sewing tools comprise a needle bar, which is driven up and down and oscillates in the horizontal direction, and a needle, which is provided at the bottom end of the needle bar and interacts with a looper mounted in the base plate, the needle being drivable in a rotatable manner by a third motor. The sewing machine has a control device, from which various buttonhole shapes stored therein can be retrieved.

DE 33 02 385 A1 discloses a conventional sewing machine of the foregoing type. Stepper motors are used, so that this sewing machine can be controlled digitally. The table motion can be controlled by a suitable control program in such a way that various buttonhole shapes can be cut and sewn or stitched. Complicated cam mechanisms are not necessary for producing the buttonhole bead, in either the pre- or the post-cutting mode.

In the pre-cutting mode, the material to be sewn is cut first and then the buttonhole bead is produced around the incision; in the post-cutting mode, first the buttonhole bead is produced and then the material to be sewn is cut. In the pre-cutting mode, it is necessary for the opposite seam rows to lie exactly next to one another, so that fraying of the pre-cut material is prevented. On the other hand, in the post-cutting mode, an intermediate space (intermediate material within the buttonhole bead) must remain clear between the two opposite stitch rows forming the buttonhole bead, so that the subsequent cutting of the buttonhole cuts only the material to be sewn and not the already-sewn buttonhole bead.

In the known sewing machine, it is not apparent how the bead can be precisely positioned in the pre- and post-cutting modes as described above, or how the sewing machine can switch from the pre-cutting mode into the post-cutting mode. It is also not apparent how the zigzag stitches are produced.

There are several known methods of producing zigzag stitches. According to one method, the table, to which the material to be sewn is clipped, may be driven in an oscillating manner transversely to the sewing direction, so that the successive points pierced by the needle are offset in the transverse direction.

U.S. Pat. No. 1,991,627 discloses an eyelet-buttonhole sewing machine in which the needle bar is deflected in the horizontal direction by an oscillating shaft in order to produce the zigzag stitches, the oscillating shaft being coupled to the arm shaft via a drive mechanism.

DE 34 01 615 C2 discloses a standard sewing machine in which a zigzag motion of the needle bar is initiated via a stepping motor. However, buttonholes cannot be produced with this sewing machine.

DE 41 32 586 C2 discloses an eyelet-buttonhole sewing machine in which the intermediate material which must be provided in the post-cutting mode is defined in the buttonhole bead by displacing the sewing pattern for producing a so-called offset. This offset is imparted to the transport table, which is driven by two stepper motors arranged along respective axes (x, y) disposed perpendicularly to one another. That is to say, before the forming of the stitches is started, the transport table, on which the material to be sewn is located, is put into such a position that the inner stitch, provided opposite the subsequent incision point, of the needle maintains a corresponding distance from the opposite stitch. By the storage of different data records via which the stepping motors are activated, the offset can be activated according to operating mode.

A disadvantage with this machine is that the coordinate values of the individual piercing points, that is, the activating data for the x- and y-motors, have to be re-calculated as a function of the desired offset value and the desired dimension of the intermediate material, and filed in suitable memories. If steps are lost when approaching the initial position, there is the risk of the stitches being staggered in the pre-cutting mode and of the already-formed buttonhole bead subsequently being cut open as a result.

It is also a disadvantage with this machine that two motors have to be controlled individually. The risk of data loss or of the occurrence of computing errors exists individually for each motor, so that the risk is doubled.

The disclosures of all prior art mentioned herein are expressly incorporated by reference.

In view of these problems, it would be desirable to improve the sewing machine of the conventional type in such a way that it works reliably in the pre- and post-cutting modes, and, if the sewing pattern is changed, the data for the activation of the drive motors for the table can be kept unchanged.

SUMMARY OF THE INVENTION

To solve this problem, a sewing machine may advantageously comprise a device for switching over to the post-cutting mode, and a needle-oscillating device driven by a fourth motor and producing the zigzag stitches, in which the oscillating motion of the needle can be controlled by the fourth motor in order to produce the intermediate material within the buttonhole bead which is required in the post-cutting mode, and in which the stitch position and if need be the stitch width are variable under program control.

With the separate motor, controllable by the control unit, for producing the needle-deflection motion, the need for input and storage of two data sets is reduced to a single data set. This leads to less complex computing operations and thus to more reliable calculation of the data and to simplified control. Compared with conventional needle-deflecting mechanisms, this mechanism can be reduced to a few parts in the machine according to the invention. The manufacturing and assembly costs for the sewing machine are thereby reduced. In addition, the stockkeeping costs are reduced on account of the smaller number of parts. The use of the fourth motor, in addition to permitting the stitch-position change, also enables the stitch width to be changed by software, so that an eyelet buttonhole to be produced may be designed in a greater variety of shapes.

The fourth motor is preferably likewise a stepping motor.

If the change in the position of the zigzag stitches is effected while maintaining its width, this offers the advantage that only one parameter change is necessary in order to produce the buttonhole bead in the post-cutting mode. The stitch width may of course be reduced if the visual impairment of the buttonhole becomes too great as a result of inserting the intermediate material while the stitch width stays unchanged.

To further automate the sewing operation, it is advantageous to provide a data-input device, by which the various parameters (e.g., incision length, permissible positions of the inner stitch in the buttonhole bead in the pre-cutting mode and the post-cutting mode, piercing position of the inner stitch above the incision in the post-cutting mode, position of the inner stitch below the incision in the pre-cutting mode, width of the intermediate material) of a buttonhole can be input into the control device; and at least one memory, in which the needle piercing coordinates, calculated from the parameters, for producing the buttonhole bead in one of the modes (pre-cutting mode or post-cutting mode) can be stored. Additional memories may be provided in order to produce further buttonhole shapes, which may be changed in response to fashion, for example, or to file the data for the pre-cutting mode and the post-cutting mode in separate memories.

The stepping motor controlling the needle-oscillating motion is controlled by the control device in accordance with the calculated coordinates.

An especially simple design of the needle-oscillating device is possible if this needle-oscillating device comprises an oscillating shaft, which has a toothed segment and meshes with a drive pinion of the fourth motor.

To simplify the control, all four motors are preferably controlled according to the calculated needle piercing coordinates. The motors for driving the table and the motor for the rotary drive of the sewing tools are also preferably stepping motors in each case. Especially precise control of the sewing machine is then possible as a result.

Other features and advantages of the present invention will become apparent from the following description of an embodiment of the invention which refers to the accompanying drawings.

BRIEF DESCRIPTION OF THE DRAWINGS

FIG. 1 shows the front view of an eyelet-buttonhole sewing machine according to an embodiment of the invention;

FIG. 1*a* shows a detail, identified by Ia, of FIG. 1 in schematic representation;

FIG. 3 shows a sectional view of a bottom part of the sewing machine taken along section line III—III in FIG. 1;

FIG. 4 shows a sectional view taken along section line IV—IV in FIG. 1 on an enlarged scale;

FIG. 5 shows a view taken in the direction of arrow V in FIG. 2;

FIG. 6 shows a view in the direction of arrow VI in FIG. 2;

FIG. 7 shows a sectional view taken along section line VII—VII in FIG. 6;

DETAILED DESCRIPTION OF AN EMBODIMENT OF THE INVENTION

Figure 2:
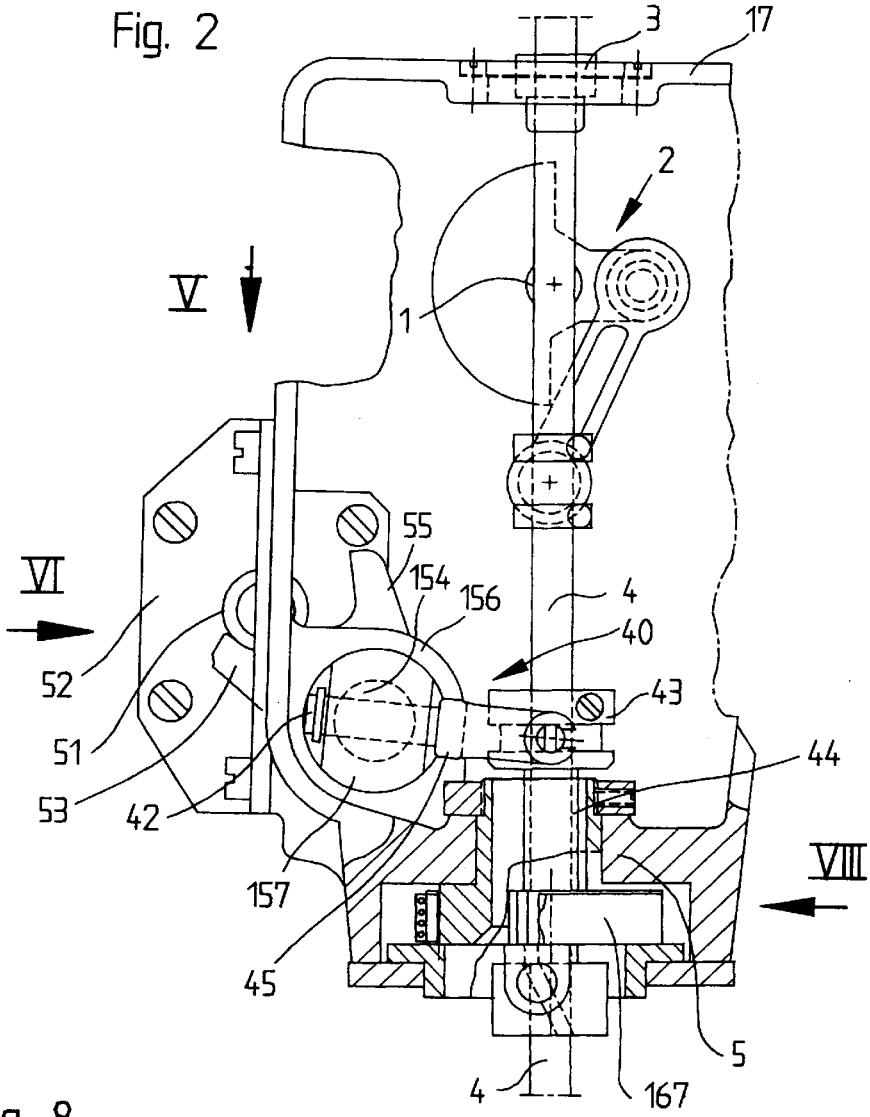
FIG. 2 shows an enlarged view of the sewing machine head taken in the direction of arrow II in FIG. 1, the button bearing for the needle bar being shown partially in cross-section.
Figure 8:
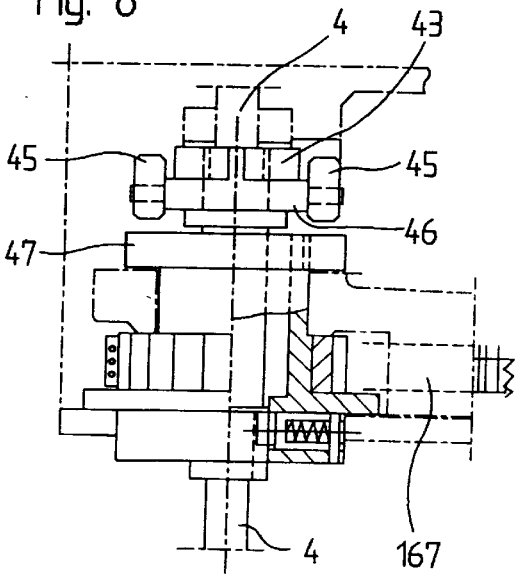
FIG. 8 shows a view taken in the direction of arrow VIII in FIG. 2.

As shown in FIG. 1, the sewing machine has a housing 17 which is composed of the base plate 12, the column 16 and the arm 22. The arm shaft 1, mounted so as to be rotatable in the arm 22, is driven via a motor 18 and a belt drive, having two toothed-belt pulleys 23, 24 and a toothed belt 20, and drives the needle bar 4 up and down via a crank drive 2.

The needle bar 4 is mounted vertically in the arm 22 in bearings 3, 5. Inserted into the bottom end of the needle bar 4 is the needle 6, which interacts with the looper 11. The needle bar 4, the needle 6 and the looper 11 form the sewing tools.

Figure 15:
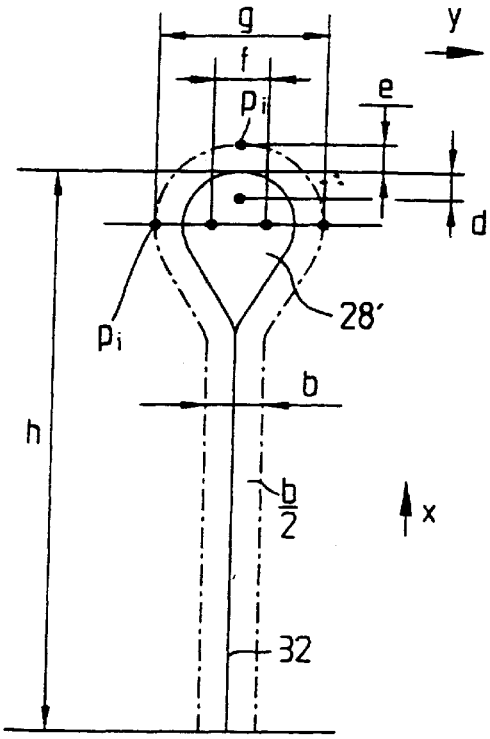
FIG. 15 shows a schematic representation of the various parameters of the eyelet of an eyelet buttonhole.
Figure 16:
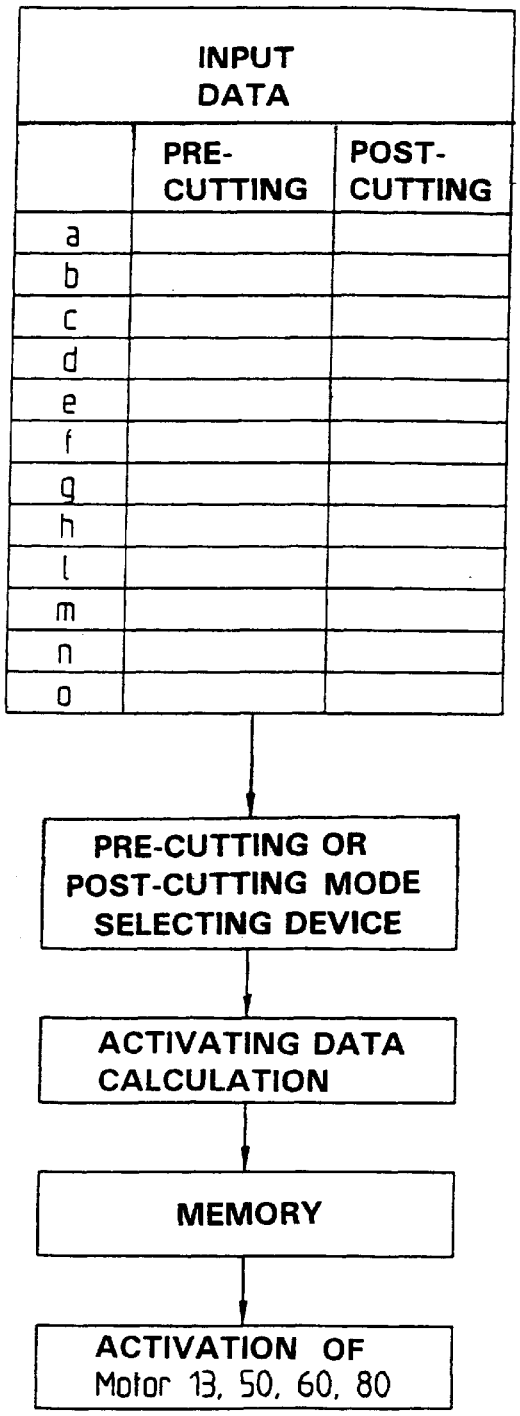
FIG. 16 shows a flow chart for data input and for activation of a fourth motor.

A looper bearing 7 including the looper 11 is rotatably mounted in a top bearing 8 and a bottom bearing 10. The rotary position of the looper 11 is set by the stepping motor 13 and the belts 15, 165. The sewing tools 4, 6, 11 are coupled to one another by the adjusting shaft 162, the toothed-belt pulleys 163, 164 provided thereon, and the belt 167, so that the needle bar 4 and the looper 11 can be rotated in synchronism in order to produce the buttonhole eyelet 28' (see FIG. 15).

The oscillating horizontal motion of the needle bar 4 for producing the zigzag stitches is initiated by the zigzag device 40 shown in FIG. 2. The oscillating shaft 154 is mounted in a bearing 155 and a bearing 156. A forked lever 45 embraces the adjusting ring 43, which is part of a bearing bush for the needle bar 4. The forked lever 45 is provided with a stem 42, which projects in the direction pointing away from the needle bar 4. This stem 42 engages in a thick end of the oscillating shaft 154 (see FIG. 5). The amplitude of the needle deflection, that is the stitch width a, can be set by changing the pivoting motion of the oscillating shaft 154. Provided for this purpose is the stepping motor 50, which is to be explained in more detail below.

Figure 9:
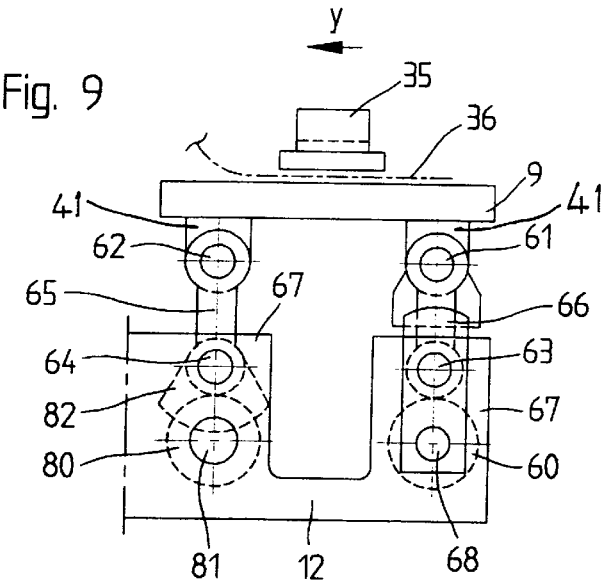
FIG. 9 shows a view taken in the direction of arrow IX in FIG. 1*a;*

As shown in FIG. 1*a* and FIG. 9, the table 9 is driven by the two stepping motors 60, 80 in the directions x, y, which are perpendicular to one another. The drive in the x-direction is effected via the stepping motor 60, and the drive in the y-direction is effected via the stepping motor 80. The table 9 is formed with bearings 41, which enclose rods 61, 62 in such a way that the rods are displaceable in the x-direction. At both their ends, the rods 61, 62 are firmly connected to pairs of links 66, 65, respectively, which are firmly connected at their other ends to rods 63, 64. The rods 63, 64 are rotatably accommodated in bearings 67 of the base plate 12. The rods 61, 62, 63 and 64 are arranged parallel to one another.

The described arrangement forms a parallelogram-shaped parallel-link guide which permits displacement of the table 9 in the y-direction. In addition, the arrangement permits displacement of the table 9 on the rods 61, 62 in the x-direction.

The motor 60 is in drive connection with a spindle 68, which is rotatably mounted in the bearings 67 on the base plate 12. Mounted on the spindle 68 is a nut 69, which has a driver 69'. The driver 69' engages in a groove 70, which is formed in the bearing 41 which accommodates the rod 61. A rotary motion of the spindle 68 causes the nut 69 to be displaced in the x-direction as a function of the direction of rotation and also causes the nut 69 to displace the table 9 on the rods 61, 62 in the x-direction via its driver 69' and the groove 70.

The stepping motor 80 is arranged parallel to the stepping motor 60 and drives a gear 81, which meshes with a toothed segment 82 fastened to the rod 64. A rotary motion of the gear 81 causes a pivoting motion of the link 65 and thus to a motion of the table 9 in the y-direction. With this arrangement, the motion of the table 9 runs on a curved path. However, since the motion transverse to the buttonhole bead 28 is only slight (stitch width a), the component of motion of the table 9 in the direction of the needle 6 may be neglected.

As shown in FIGS. 2, 5 and 7, the stepper motor 50 is mounted on a motor holder 52 in such a way as to be half outside and half inside the housing 17. Its drive pinion 51 meshes with a toothed segment 53, which is provided on a lever 54, which is connected to the oscillating shaft 154 via a clamping device 153. In order to limit the deflection motion of the lever 54, the lever 54 is provided with a stop plate 55 forming two stops. An oscillating motion of the pinion 51 results in an oscillating motion of the oscillating shaft 154, which, as already explained, is connected to the bearing bush accommodating the needle bar 4.

Figure 10:
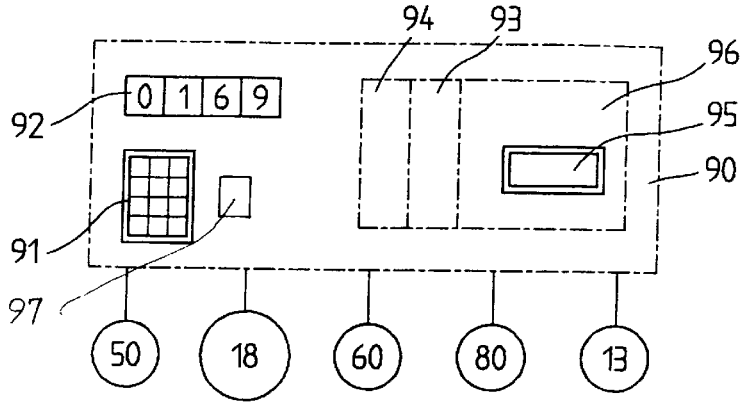
FIG. 10 shows a schematic representation of a control unit for activating motors.

FIG. 10 shows the control unit 90 of the sewing machine in a purely schematic form. The various parameters (a to o) of an eyelet buttonhole can be input via a keypad 91 and reproduced in the display 92. The parameters of an eyelet buttonhole which are to be input can be described with reference to FIGS. 11 to 15. The stitch width a determines the seam pattern. The incision 32 has a definable length h. In the buttonhole eyelet 28', the inner needle piercing points $P_i$ are established.

Thus, in the pre-cutting mode, the maximum distance f between the inner needle piercing points $P_i$ in the y-direction and the offset d of the needle piercing inward relative to the incision length h are input. The same applies to the width l of a crossbar or to the variable stitch widths m, n, o. In the post-cutting mode, first of all the value b/2 determining the intermediate material width b, that is, the offset of the inner needle piercing in the y-direction for the straight section of the buttonhole bead 28, and the distance g, which describes the maximum distance between the opposite inner needle piercings in the buttonhole eyelet 28', and the dimension e, which defines the offset of the inner needle piercing point $P_i$ in the x-direction relative to the cut length h, are input.

The piercing data (coordinates) are calculated from these input data inside the control unit 90 and are filed in a memory 93. A second memory 94 may also be provided, in which case the second memory 94 is provided for the data in the pre-cutting mode and the memory 93 is provided for the data in the post-cutting mode. The control unit 90 may be provided with a floppy-disk drive 95 or another storage or input device, by which various sewing patterns stored on floppy disks or other media can be read into the main memory 96.

Also provided in the control unit 90 is a device 97, such as a single-pole, single-throw switch, by which the operator can switch over the sewing machine from the pre-cutting mode to the post-cutting mode or vice versa. In response to such switching over the control data for the needle piercing points $P_{ix}/P_{iy}$ are read out from the memories 93, 94 and serve to activate the motor 50 for producing the needle deflection motion.

The data contained in the main memory 96 serve to control the main drive motor 18, the motors 60, 80 for driving the table 9, and the motor 13 for changing the rotary position of the sewing tools 4, 6, 11.

Figure 12:
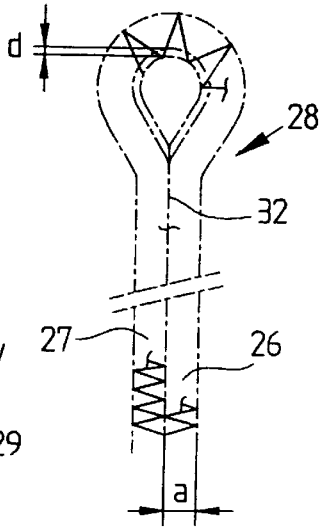
FIG. 12 shows an eyelet buttonhole produced in the pre-cutting mode on an enlarged scale.

The mode of operation of the sewing machine is explained briefly below:

In the pre-cutting mode, a buttonhole bead 28, as shown in FIG. 12, is produced in the material 36 to be sewn, which is fixed to the table 9 by the clip 35. In this mode, the inner piercing points $P_i$ of the needles 6 of the opposite stitch rows 26, 27 located in the longitudinal region of the buttonhole bead 28 must be adjacent to each other or correspond to one another, so that the incision 32 that was produced by the cutting device 34 before the sewing does not fray but instead is enclosed by the stitch rows 26, 27. The inner needle position points $P_i$ of the zigzag stitch are offset into the interior region of the eyelet 28' by the dimension d, so that the cut edges of the incision 32 are covered all around the eyelet buttonhole 28. The width a of the zigzag stitch (stitch width) is determined by the dimension of the oscillating motion of the stepping motor 50.

Figure 11:
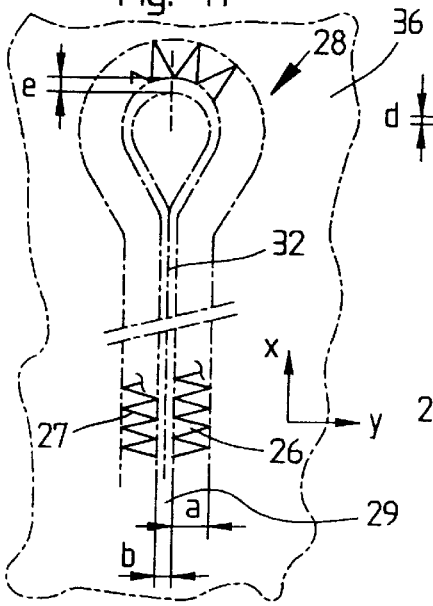
FIG. 11 shows an eyelet buttonhole produced in the post-cutting mode on an enlarged scale.

FIG. 11 shows an eyelet buttonhole 28 produced in the post-cutting mode. An intermediate material 29 of width b must be set between the two opposite stitch rows 26, 27 in the longitudinal region, and this intermediate material 29 enables the incision 32 to be formed after the sewing without the eyelet buttonhole 28 being cut open in the process. In the region of the eyelet 28', a distance e is set between the inner needle piercing points $P_i$ and the incision point. In both the post- and pre-cutting modes, the stitch width a can be kept constant. The position of the zigzag stitch (stitch position) can be set by extending the rotary motion of the stepping motor 50 in one direction and correspondingly reducing the rotary motion in the other direction, so that the lever 54 pivots farther in one direction, but less far in the other device. The inner piercing point $P_i$ of the needle 6 is thereby displaced by the dimension b/2. In a similar manner, the displacement in the buttonhole eyelet 28' is effected by the dimension e, which has been determined beforehand in the control unit 90. By electronically coupling the motor 50 to the motor 13 and thereby coupling the needle-bar oscillating motion to the rotary motion of the looper 11 and the needle bar 4, the stitch position can be set while maintaining or changing the stitch width a, as a function of the stitch currently to be executed, and for all the stitches to be executed for a given buttonhole program.

Figure 13:
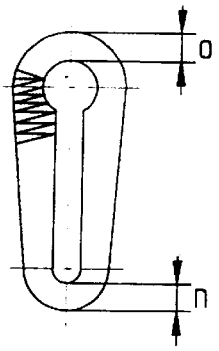
FIG. 13 shows a first modification of an eyelet buttonhole.
Figure 14:
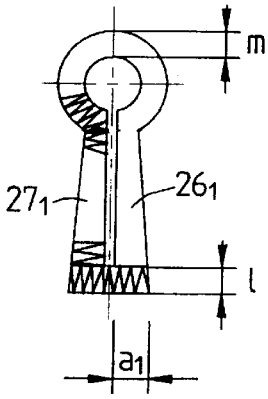
FIG. 14 shows a second modification of an eyelet buttonhole.

Owing to the fact that both the stitch position and the stitch width can be freely set via the stepping motor 50, a wide variety of buttonhole shapes, which may be required according to various fashions, for example, can be sewn with the machine. Such buttonhole shapes are shown in FIGS. 13 and 14. Even a variable stitch width $a_1$ within a buttonhole bead $26_1$, $27_1$ is possible. Crossbars having the stitch width l may likewise be sewn.

Although the present invention has been described in relation to a particular embodiment thereof, many other variations and modifications and other uses will become apparent to those skilled in the art. Therefore, the present invention is not limited by the specific disclosure herein.

What is claimed is:

1. A sewing machine for producing an eyelet buttonhole in a material to be sewn, the buttonhole being provided by an incision in the material and a buttonhole bead comprising zigzag stitches sewn around the incision, the incision being producible either before or after the zigzag stitches, the sewing machine comprising:

a frame;

a table on said frame for accommodating the material; first and second motors mounted on said frame and linked to said table for moving said table in two respective directions;

a needle bar carrying a needle and being mounted on the frame for being driven up and down with respect to the table for sewing said buttonhole bead;

a looper cooperating with said needle, said looper being mounted on said frame and being drivable rotationally by a third motor;

a cutting device arranged on said frame for forming said incision in said material;

a zigzag device on said frame comprising a fourth motor for moving said needle horizontally to a plurality of positions to produce the zigzag stitches;

a control device for storing a plurality of parameters for each of a plurality of buttonhole shapes and for controlling said needle, said table, said looper, and said zigzag device for forming each of said plurality of buttonhole shapes; and said control device and zigzag device further being operable, when said incision is to be formed after sewing said buttonhole bead, for leaving intermediate material within said buttonhole bead so that said cutting device can form said incision in said intermediate material without damaging said buttonhole bead.

2. A sewing machine according to claim 1, wherein said first and second motors are stepper motors.

3. A sewing machine according to claim 2, wherein said third motor is a stepper motor.

4. A sewing machine according to claim 1, wherein said third motor is a stepper motor.

5. A sewing machine according to claim 1, wherein said fourth motor is a stepper motor.

6. A sewing machine according to claim 1, wherein said control device comprises at least one data input device and at least one memory, for inputting and storing said parameters, and said control device is operable for determining needle piercing coordinates from said parameters for controlling all four of said motors to produce said buttonhole bead, both in a pre-incision mode when said incision is formed before said buttonhole bead, and in a post-incision mode when said incision is formed after said buttonhole bead.

7. A sewing machine according to claim 6, wherein said control device maintains a constant stitch width in both said pre-incision and said post-incision modes.

8. A sewing machine according to claim 1, wherein said zigzag device comprises a drive pinion on said fourth motor, and an oscillating shaft having a toothed segment thereon, said drive pinion being meshed with said toothed segment.

9. A sewing machine according to claim 8, wherein said toothed segment is formed on a lever which is connected to the oscillating shaft.

10. A sewing machine according to claim 9, wherein said lever further has stops for limiting movement of said toothed segment.

11. A sewing machine according to claim 10, wherein said stops are formed on a stop plate which is connected to said oscillating shaft and separate from said lever.

12. A sewing machine according to claim 1, wherein said fourth motor is coupled to said needle bar for moving said needle bar horizontally.

* * * * *